United States Patent [19]

Masachika

[11] Patent Number: 4,489,662

[45] Date of Patent: Dec. 25, 1984

[54] AFTER HOUR DEPOSITORY

[75] Inventor: Hiroshi Masachika, Hiroshima, Japan

[73] Assignee: Kumahira Safe Co., Inc., Japan

[21] Appl. No.: 419,605

[22] Filed: Sep. 17, 1982

[30] Foreign Application Priority Data

May 20, 1982 [JP] Japan ..... 57-84010

[51] Int. Cl.[3] ..... E05G 1/026

[52] U.S. Cl. ..... 109/66; 232/44

[58] Field of Search ..... 109/66, 55, 74, 70; 232/44, 43.1

[56] References Cited

U.S. PATENT DOCUMENTS

| | | | |
|---|---|---|---|
| 2,617,584 | 11/1952 | Behrens | 109/66 |
| 2,901,165 | 8/1959 | Krug | 232/44 |
| 3,465,955 | 9/1969 | Boer et al. | 232/44 |
| 3,762,634 | 10/1973 | Leipelt | 232/44 |
| 3,784,090 | 1/1974 | Markham | 232/44 |
| 4,063,520 | 12/1977 | Parsons | 109/66 |
| 4,176,610 | 12/1979 | Markham et al. | 109/66 |

*Primary Examiner*—Gene Mancene
*Assistant Examiner*—John G. Weiss
*Attorney, Agent, or Firm*—Cushman, Darby & Cushman

[57] ABSTRACT

A depository includes a frame, a door casing pivotally mounted to the frame for movement between closed and open positions, a movable wall member pivotally mounted to the door casing to permit pivotal movement thereof in response to the door casing being moved between the closed and open positions. A security mechanism is provided so that direction reversal of the pivotal movement of the door casing is prevented by virtue of a pair of ratch members which define a space therebetween and in which a roller moves during pivotal movement of the door casing towards the closed position. A cam surface is defined on one of the ratch members which also has a linkage member pivotally attached thereto so as to be movable between an engaged and disengaged position with respect to the other ratch member. The other ratch member defines a latch surface so that when the roller moves in the space defined between the pair of ratch members, the linkage member is responsively moved to the disengaged position and thereafter, the roller comes into contact with the latch surface so as to prevent direction reversal of the door casing for security reasons.

23 Claims, 14 Drawing Figures

AFTER HOUR DEPOSITORY

BACKGROUND OF THE INVENTION

1. Field of the Invention

The present invention relates to an improved after hour depository and more particularly to an after hour depository which is simple in structure and has excellent rigidity, maneuverability of opening and closing operations and high security.

2. Description of the Prior Art

Hitherto known after hour depositories are typically constructed such that a chute extends from a depository opening through the outside wall of the building of the bank to a safe or a money depositing receptacle with a door opening and closing device arranged outward of the entrance chute whereby a bag or an envelope including money to be deposited slides down through the chute by gravity when the door opening and closing device is operated.

Since a bag or an envelope is used as a money carrying means, separate depository openings are arranged for the bag and the envelope. As far as an after hour depository is concerned, the most important thing is that the optimum preventive arrangement is made for the purpose of protecting and preventing any criminal activity from being practiced from the outside such as attempts to defeat the depository security with the aid of a steel wire or like means since after hour depositories are utilized during night hours. Thus excellent high security should be ensured for the after hour depository.

The above-mentioned attempt to defeat the depository security includes intentional criminal activities such as picking-up of a bag or the like by means of a fishing hook or a trapping aid plugging the chute, and mechanical damage and removal of a depository door for the purpose of stealing money deposited or being deposited in the receptable for the night hours. When an unauthorized person who is desirous of stealing deposited money in an after hour depository is well aware of the interior structure of the depository, a variety of security defeating actions may be conducted without much difficulty. Thus, perfect prevention from an occurrence of any kind of criminal activity inevitably causes an after hour depository to become complicated and thereby are manufactured at an expensive cost.

Particularly, the more complicated a locking mechanism for the after hour depository that is designed, the greater the number of steps there are during manufacture and assembly thereby resulting in increased manufacturing costs.

SUMMARY OF THE INVENTION

The present invention is intended to obviate the disadvantages inherent to the conventional depositories as described above by way of a number of research and development activities. Thus, it is an object of the present invention to provide an improved after hour depository which is entirely free from the above disadvantages.

It is another object of the present invention to provide an after hour depository which is very simple in structure and is manufactured at an inexpensive cost.

It is another object of the present invention to provide an after hour depository which has excellent rigidity and is easy to be handled by a bank visitor or customer.

It is still another object of the present invention to provide an after hour depository which has high security.

Other objects and advantageous features of the present invention will be readily understood from the reading of the following description made in connection with the accompanying drawings.

BRIEF DESCRIPTION OF THE ACCOMPANYING DRAWINGS

The present invention will be described in more detail with reference to the accompanying drawings which illustrate a preferred embodiment of the present invention and wherein.

Figure 7:
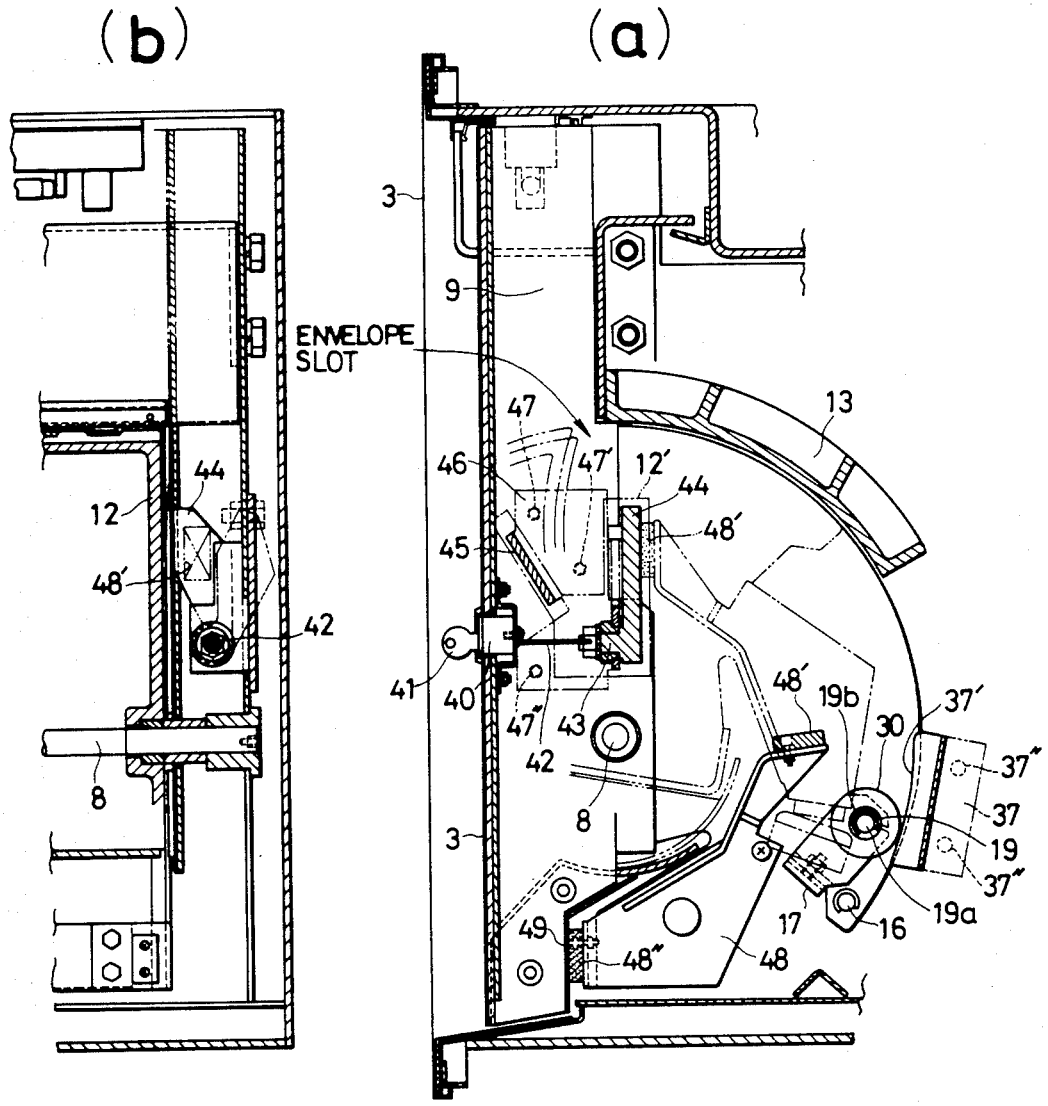
Figure 8:
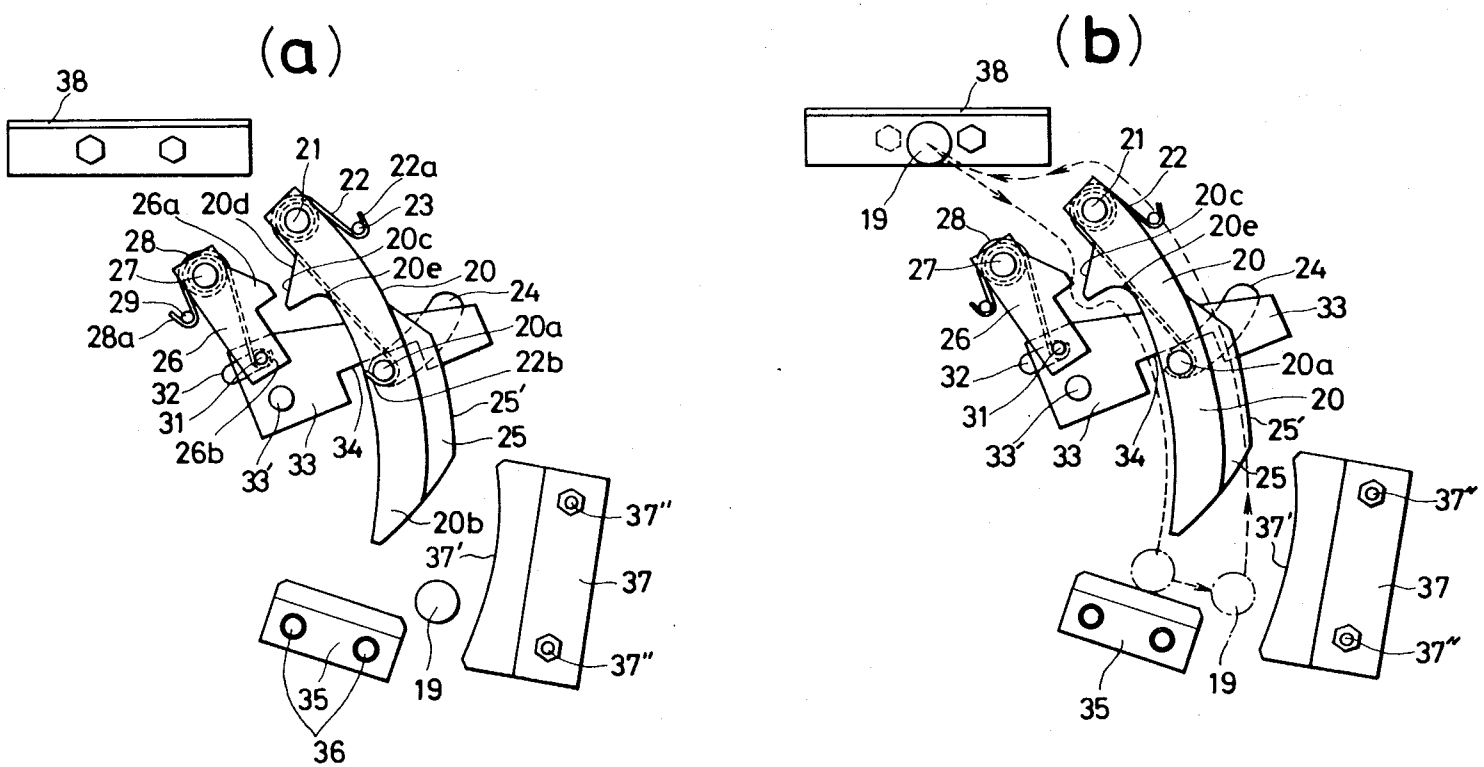
Figure 8:
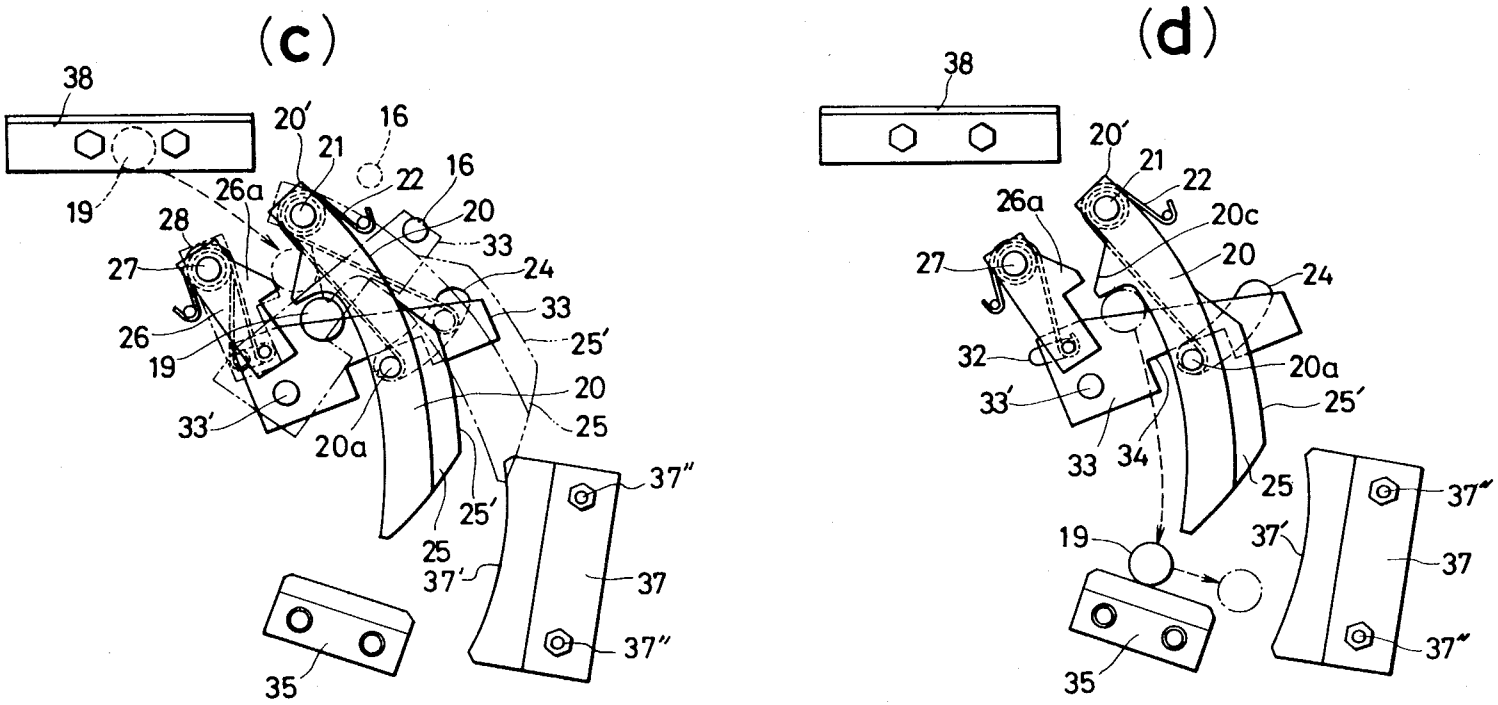
Figure 9:
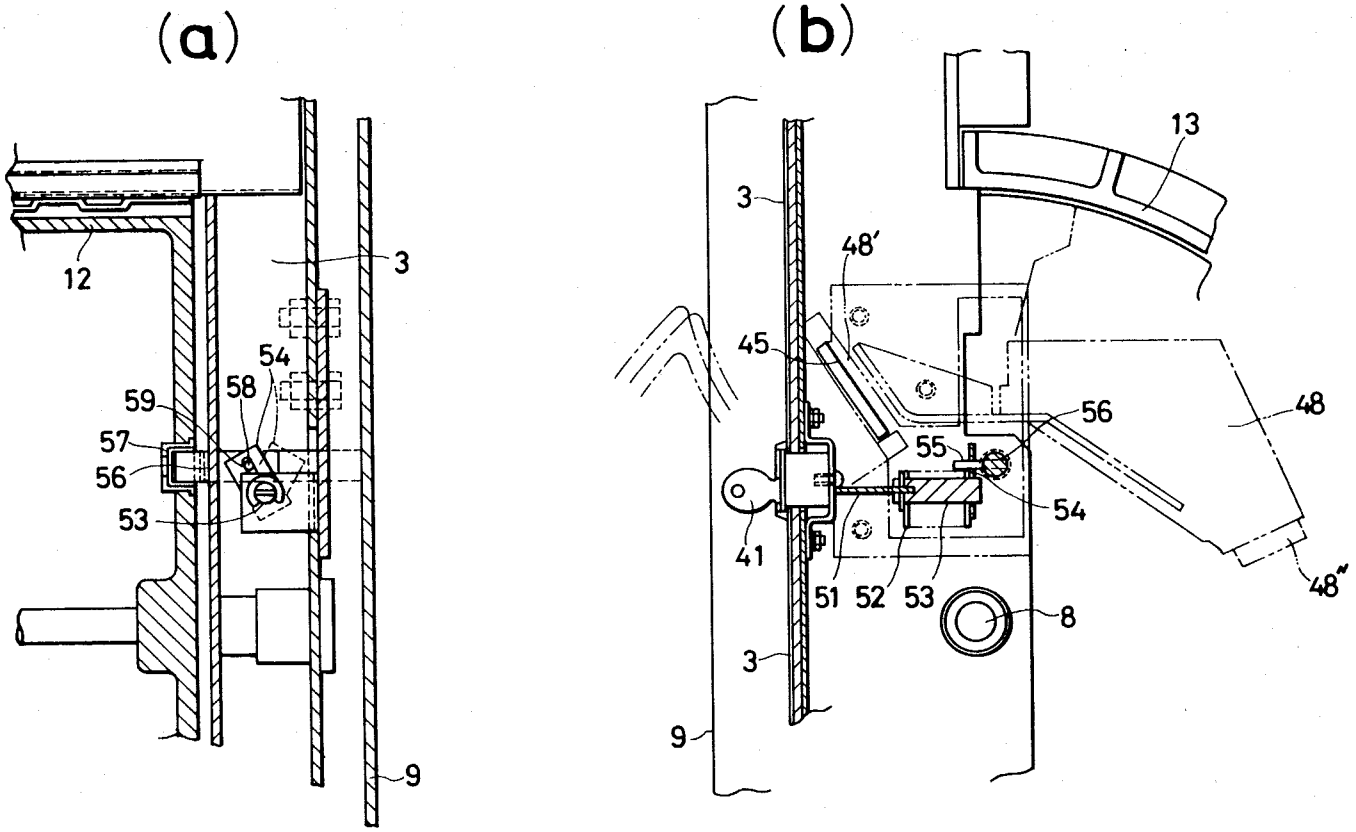

FIGS. 7(*a*) and (*b*) are a sectional view of the after hour depository respectively, particularly illustrating a locking device in accordance with the present invention;

FIGS. 8(*a*), (*b*), (*c*) and (*d*) are a schematic side view of a combination of sleeve rollers and ratch mechanism in different operative positions respectively, shown in an enlarged scale; and FIGS. 9(*a*) and (*b*) are a sectional view of a locking device in accordance with a modified embodiment of the present invention respectively, shown in a different orientation.

DETAILED DESCRIPTION OF THE PREFERRED EMBODIMENTS

Figure 1:
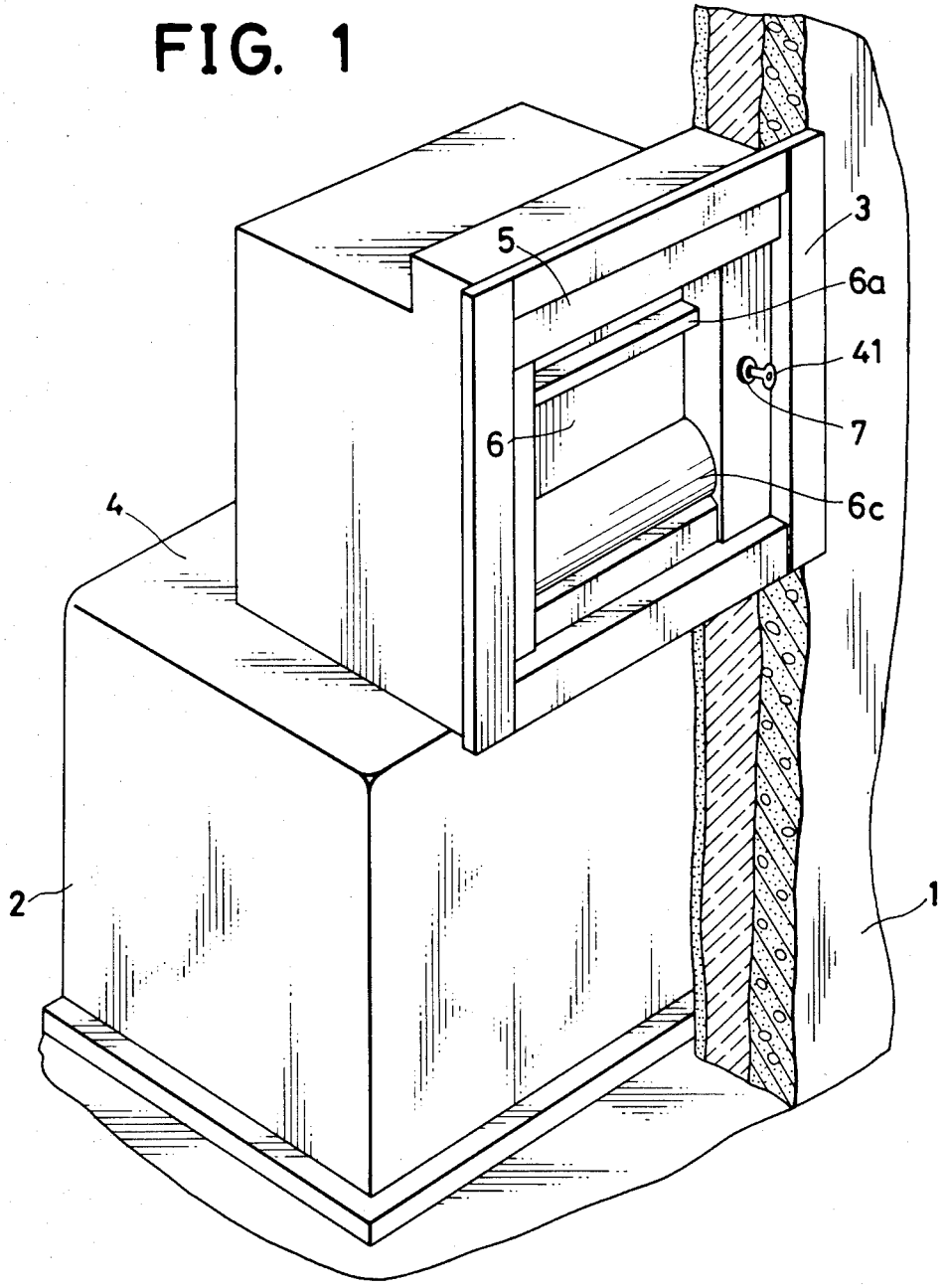
FIG. 1 is a perspective view of an after hour depository fitted into a wall structure of a building which is depicted in section for the convenience of clear illustration.
Figure 2:
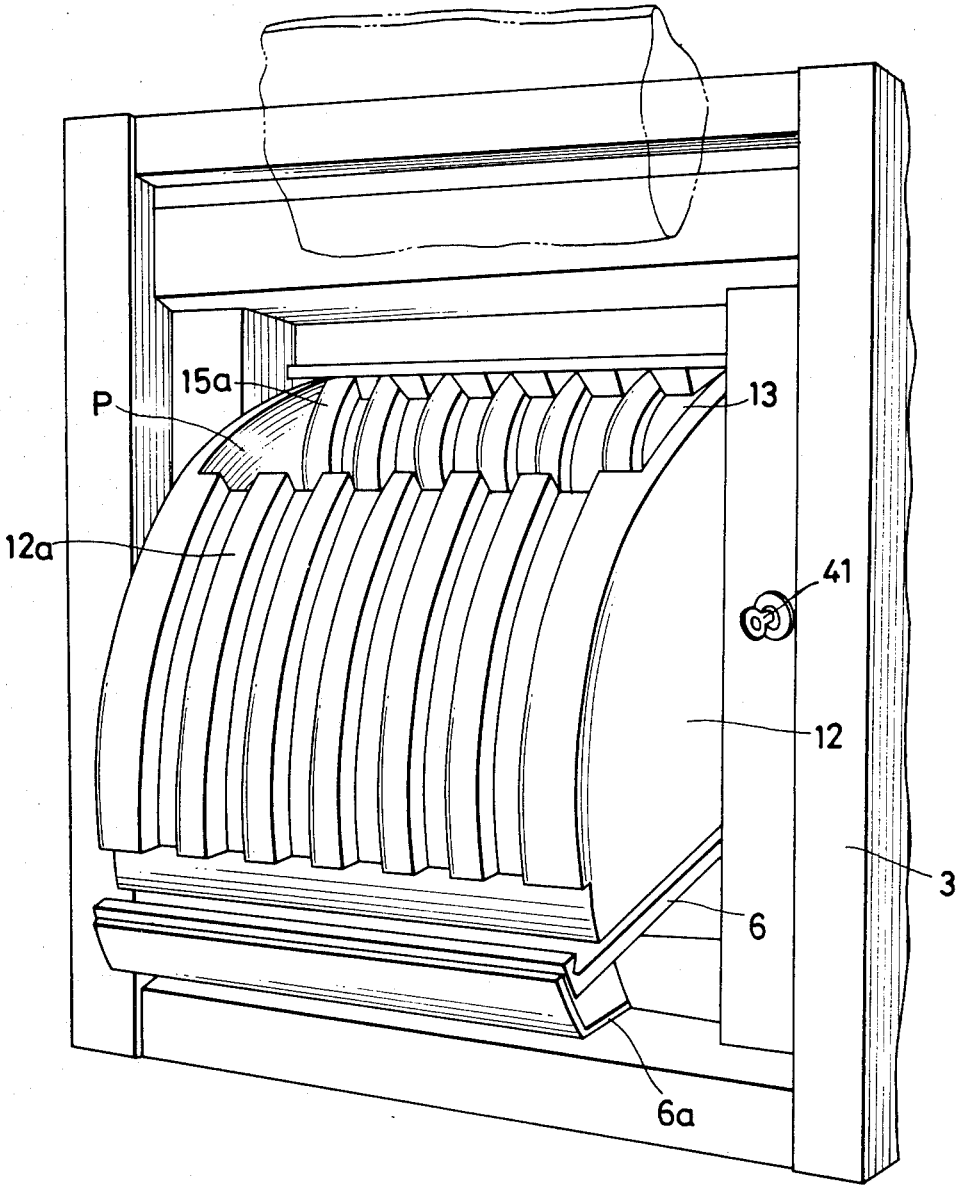
FIG. 2 is a perspective view of the after hour depository in FIG. 1, wherein the door is shown in an opened state.

Referring to FIG. 1, an after hour depository 2 is stationarily installed inside a wall structure 1 of a building having a square opening fitted with a framework 3. A chute 4 extends into the after hour receptable 2. Reference numeral 5 designates a lamp to illuminate the exterior of depository 2. Reference numeral 6 designates a front plate of a door casing 12. The front plate 6 includes a hand 6*a* at the upper part and a holding portion 6*b* at the lower part thereof, the holding portion 6*b* being bent inwardly relative to the wall structure 1. Further, the framework 3 is formed with a lock hole 7 into which a lock is fitted so as to effect locking and unlocking by means of a key 41.

Figure 3:
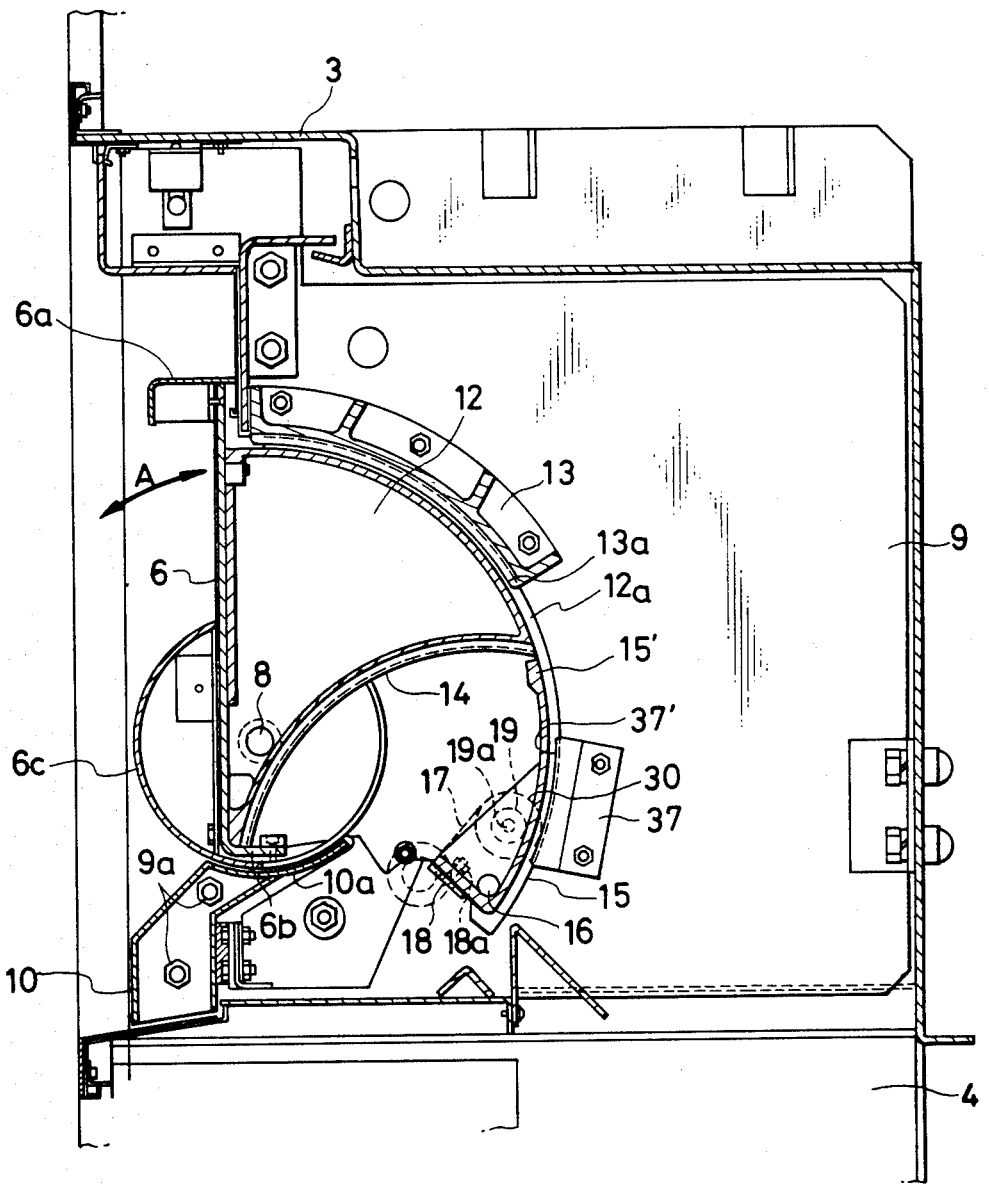
FIG. 3 is a vertical sectional view of the after hour depository with the door fully closed.
Figure 4:
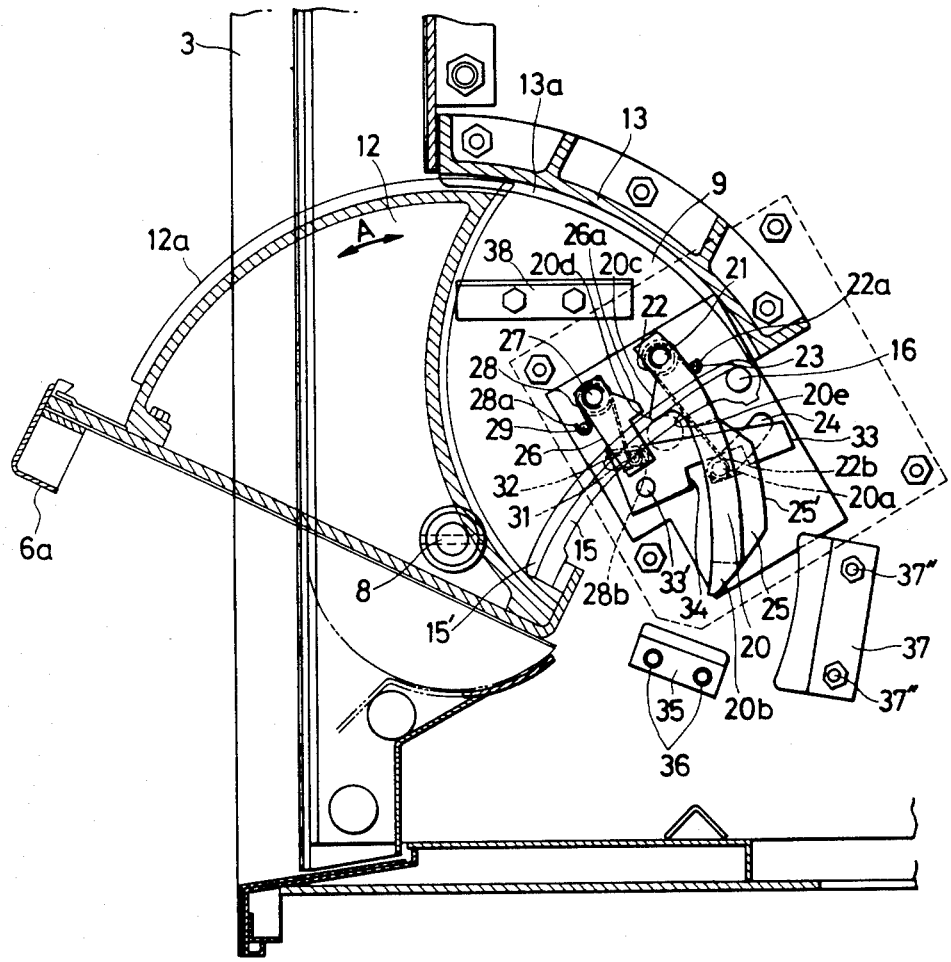
FIG. 4 is a vertical sectional view of the after hour depository similar to FIG. 3 but with the door half opened.

As is best seen from FIG. 3, the front plate 6 of the door casing 12 includes a half cylinder portion 6*c* at the lower part thereof and a pivotal shaft 8 extends across both the side walls 9 of the after hour depository 2 along the center line of the half cylinder portion 6*c*. Thus, the door casing 12 is held rotatably about pivotal shaft 8. Further, below the half cylinder portion 6*c* there is arranged a guide member 10 which includes a trough-shaped guide 10*a* fixedly secured to the inside surface of the side walls 9 by means of set screws 9*a*. Reference numeral 12 designates a door casing which is integrally connected to the front plate 6 and has a sector-shaped cross-sectional configuration. Specifically, the door casing 12 is rotatable about the pivotal shaft 8 in both directions as identified by arrow A (see FIGS. 3 and 4) with the aid of a guide member 13 which is brought into contact with the door casing 12 along the curved surface of the latter in such a manner that the corrugated surface 12*a* of the door casing 12 is in engagement with the corresponding corrugated surface 13*a* of the guide member 13. Further, the door casing 12 includes a concave partition 14 constituting the rear wall thereof and a movable wall 15 is arranged rotatably about a shaft 16 which is located at the lower end part of the door casing 12 thereof. Shaft 16 is located at the center of the curvature of the concave partition 14 whereby the upper end of the movable wall 15 is caused to move along the curvature of the partition 14. As a result a pocket P is developed when the door casing is drawn forward.

Further, a pair of arms 17 are fixedly secured to the lower extension of the movable wall 15 by means of bolts 18 and nuts 18*a* at both the sides thereof and a sleeve roller 19 is disposed rotatably about a shaft 19*a* at the free end of the respectively arms 17. Reference numeral 19*b* designates a snap ring which is fitted onto the shaft 19*a* adjacent to the sleeve roller 19.

On the side wall 9 of the after hour depository is arranged a ratch 20 including on the lower face thereof an engagement pawl 20*c* is projecting outwardly therefrom. Specifically, ratch 20 is swingable about shaft 21 horizontally extending from the side wall 9 by means of a spring 22 mounted on the shaft 21, the one end 22*a* of spring 22 being fixedly engaged to a projection 23 horizontally extending from the side wall 9, while the other end 22*b* of the spring 22 is fixedly engaged to a retaining rod 20*a* located at the central part of the ratch 20. Thus, the ratch 20 is urged to swing in the clockwise direction as seen in the drawing. The extent of swinging movement of the ratch 20 is limited by means of the retaining rod 20*b* which extends through an elongated guide hole 24 on the side wall 9.

Reference numeral 26 designates a driving plate mounted pivotally about a shaft 27 horizontally extending from the side wall 9. Drive plate 26 is formed with a feed pawl 26*a* located opposite to the rear face 20*d* of the engagement pawl 20*c* of the ratch 20. As is apparent from the drawing, the feed pawl 26*a* is located a little bit apart from the engagement pawl 20*c*.

A spring 28 is fitted onto a shaft 27 in such a manner that the one end 28*a* of said spring 28 is fixedly engaged to a projection 29 horizontally extending from the side wall 9 and the other end of the same is fixedly engaged to a connecting pin 31 at the lower end part 26*b* of the driving plate 26 to so that the latter is urged to swing in the anticlockwise direction. The lower end part 26*b* of the driving plate 26 is connected to the left end part of a holding plate 33 by way of the connecting pin 31 which extends through the driving plate 26 and projects into an elongated guide hole 32 on the side wall 9 of the after hour depository. The holding plate 33 is disposed pivotally about the shaft 33 horizontally extending from the side wall 9 and defines a rectangular recess 34 at the bottom side thereof with which the retaining rod 20*a* is brought in engagement as the holding plate 33 swings in the clockwise direction. The shaft 16 about which the movable wall 15 is adapted to rotate extends between both the side walls 9 of the after hour depository in order to depress the upper surface 25' of the back plate 25 of the ratch 20 for the purpose of preventing any security-defeating action which may be performed by an unauthorized person as described in more detail later. Reference numeral 35 designates a sliding guide plate along which the roller 19 is adapted to slide in such a manner as will be described later, sliding guide plate 35 being fixedly secured to the side wall 9 by means of bolts 36. Further, reference numeral 37 designates another guide member fixedly secured to the side wall 9 by means of bolts 37'', said guide member 37 having the same profile configuration as that of the guide member 13. Further, reference numeral 38 designates a stopper angle against which the roller 19 is adapted to abut in such a manner as will be described later, said stopper angle 38 being fixedly secured to the side wall 9 by means of bolts.

FIG. 7(*a*) is a partially sectioned side view of the after hour depository particularly illustrating a locking mechanism in accordance with an embodiment of the present invention, and FIG. 7(*b*) is a partial side view of the depository in FIG. 7(*a*). The locking mechanism as illustrated in the drawings is constructed such that a key is required to effect unlocking only when a bag or the like container including money to be deposited is put into the depository. When using an envelope or the like including money to be deposited, any bank visitor can manually open the door without a key to an extent of opening to create a slot where the envelope can be placed into the pocket. Specifically, the locking mechanism essentially comprises a cylinder head 40 fitted into the framework 3, a connecting rod 42 adapted to be turned by means of a key 41, a locking shaft 43 connected to said connecting rod 42, a rotary locking plate 44 formed integrally with the locking shaft 43, the rotary locking plate 44 being engaged to the side wall or disengaged therefrom by way of rotation of the connecting rod 42, and a stopper plate 45 which enables the door casing 12 to be drawn to the fully opened position (the second opening position) for the purpose of putting a bag or the like including money to be deposited. A seating plate 46 integral with the stopper plate 45 is fixedly secured to the side wall 9 by means of bolts 47, 47' and 47''. The rotary locking plate 44 is normally projected toward the side wall of the door member 12 so that a rotary stopper 48 having a bumper member attached to the front end thereof comes in abutment against the rotary locking plate 44 at the half opened position (the first opening position). When unlocking is effected, the rotary locking plate 44 is turned away from the side wall of the door member 12. On the other hand, while the door casing 12 is fully closed, the lower end part 48'' of the rotary stopper 48 is brought in abutment against a stopper plate 49. Thus, the door casing 12 is operated from the fully closed position to the fully opened position by way of the half opened position (the first door opening position) (the second door opening position) where the upper end 48' of the rotary stopper 48 abuts against the stopper plate 45.

Now, operation of the after hour depository constructed in the above-described manner will be described below.

Firts, operation for opening the fully closed door casing will be described.

Figure 5:
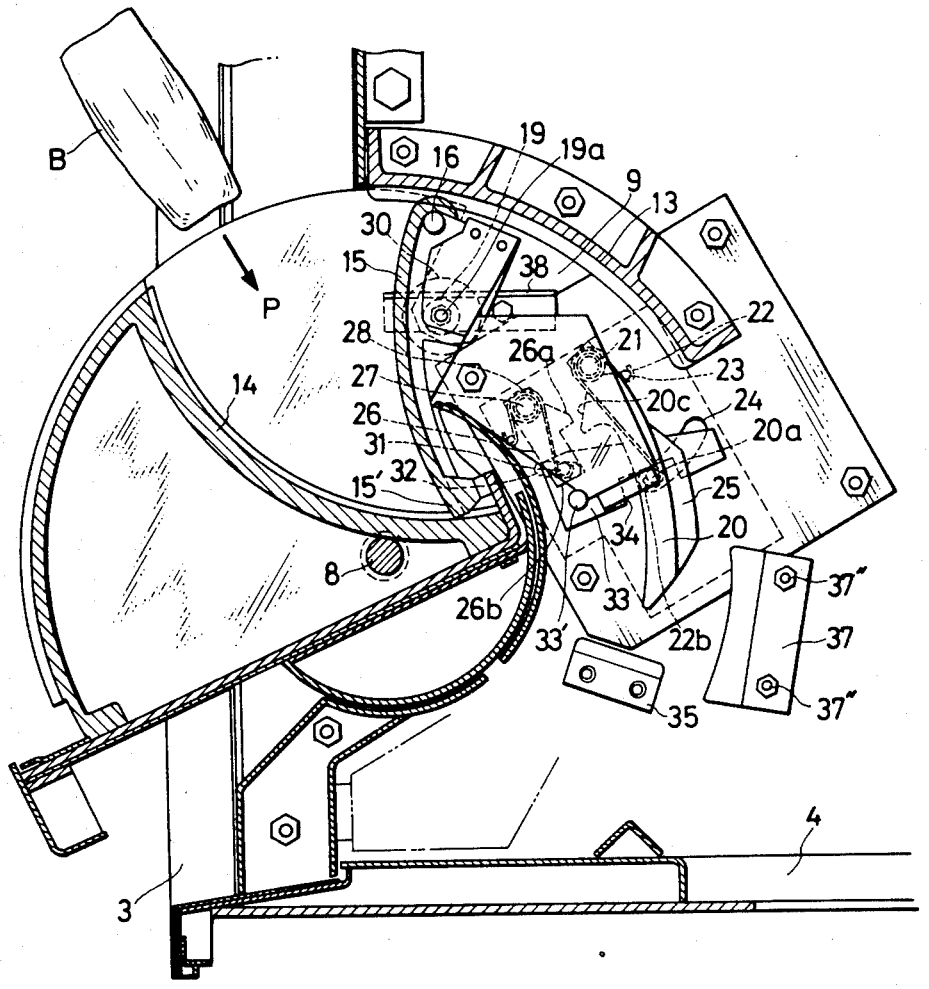
FIG. 5 is a vertical sectional view of the after hour depository similar to FIG. 3 but with the door fully opened.
Figure 6:
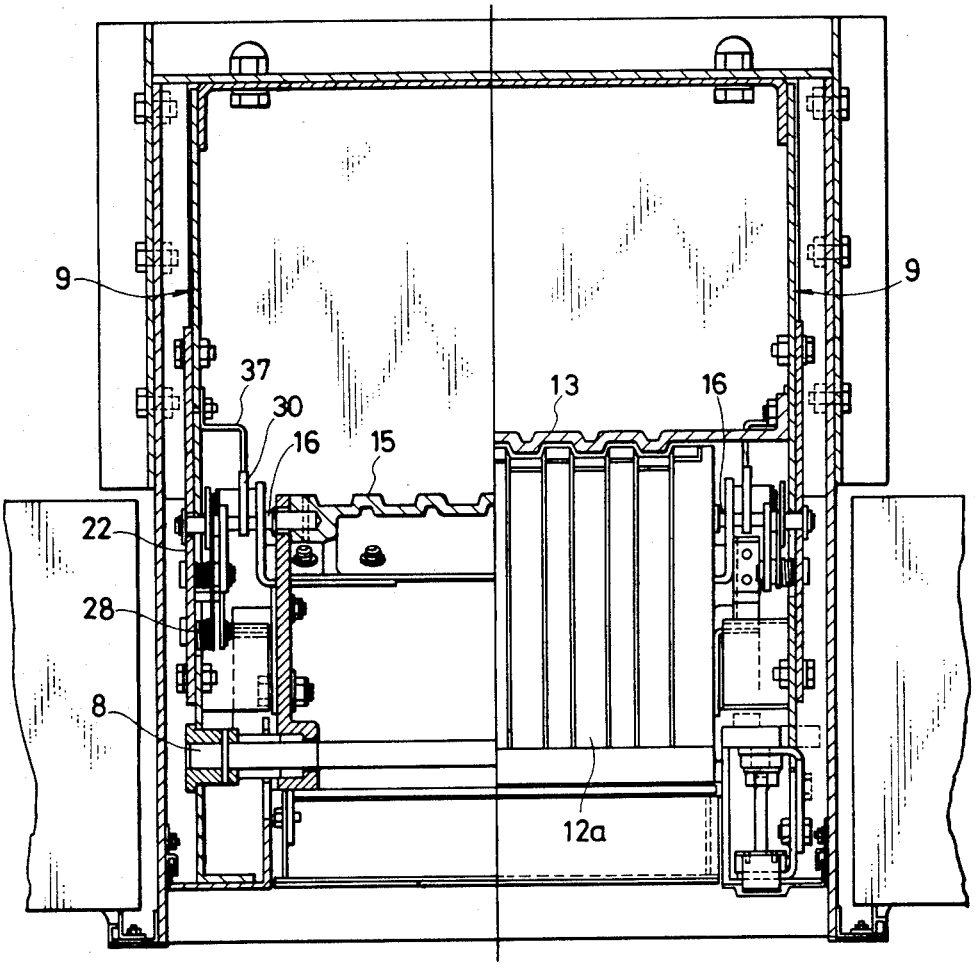
FIG. 6 is a sectional front view of the after hour depository.

The door casing 12 is drawn forward by grasping the handle 6*a* by an operator from the fully closed position as illustrated in FIG. 3 where the door casing 12 is closed and the rotary stopper 48 is lowered to the lowest position (it should be noted that the movable wall 15 is held upright by means of guide rings 30 which are adapted to come in contact against the guide member 37 so as to prevent if from turning over in the rearward direction). When the upper end part 48' of the rotary stopper 48 comes in abutment against the upper stopper plate 45, illustrated in FIG. 7(*a*), the door casing 12 is fully opened as illustrated in FIG. 5.

It should be also noted that the cylinder lock 40 must be unlocked by a key 41 to retract the rotary locking plate 44 as described earlier to make this full open.

Now, operation of the movable wall 15, the ratch 20 and the sleeve roller 19 during the door opening will be described below.

While the door casing 12 is held as fully closed, the movable wall 15 stands substantially upright and the outer curved surface of the door casing 12 forms a continuation to that of the movable wall 15. As the door casing 12 is forwardly pivoted, the guide ring 30 pivotally mounted on the shaft **19*a* of the arm 17 is caused to slide upward and comes into sliding contact with the guide surface 37' of the guide member 37. As the door casing 12 is forwardly pivoted further, the guide ring 30 is caused to slide along the guide surface of the guide member 13 while the sleeve roller 19 is caused to slide along the upper surface of the ratch 20. When the sleeve roller 19 leaves the upper edge 20' of the ratch 20, the movable wall 15 is turned in the anticlockwise direction due to its own dead weight with the free end 15' being brought into engagement with the lower extension of the front plate 6 as illustrated in FIG. 5, whereby a pocket P is developed between the door casing 12 and the movable wall 15 as illustrated in FIG. 5. As the door opening operation continues until the door casing 12 is fully opened, the upper end part 48' of the rotary stopper 48 is caused to abut against the stopper plate 45 and the door casing 12 comes to a stop. Now, the door casing 12** is ready for receiving a bag B or an envelope in the pocket P (see FIGS. 5 and 8(*b*).

Next, operation of door closing will be described below.

When a bag or envelope from the pocket P is to be inserted into the depository 2, a bank visitor manually grasps the handle **6*a* and urges the front plate 6 in the rearward direction so that the door casing 12 pivots in the clockwise direction. Specifically, the door casing 12 is pivoted about the shaft 8 which serves as a center of rotation while it is guided by means of the guide member 13. At this moment the sleeve roller 19 is caused to depress the driving plate 26 and thereby the holding plate 33 is actuated by the driving plate 26 which is operatively connected to the holding plate 33 by way of the connecting pin 31. When the holding plate 33 is disengaged from the retaining rod 20*a*, the ratch 20 becomes free to move and it swings about the shaft 21 in the anticlockwise direction against the spring 22. Then, the sleeve roller 19 moves down along the feed pawl 26*a* of the driving plate 26 and passes through the space between the driving plate 26 and the ratch 20, whereby both the driving plate 26 and the ratch 20 swing about the shafts 27 and 21 respectively in the opposite direction relative to one another. As the sleeve roller 19 continues to downwardly move, it is disengaged from the feed pawl 26*a* of the driving plate 26 and then the latter resumes the original position due to the resilient force of the spring 28. At the same time the connecting pin 31 moves back along the elongated guide hole 32 and thereby the rectangular recess 34 on the holding plate 33 comes again in engagement with the retaining rod 20*a* on the ratch 20 as the former rides on the latter. As the sleeve roller 19 moves down further, it reaches the concave part 20*e* of the engagement pawl 20*c* on the ratch 20 and then it is resiliently clamped between the driving plate 26 and the ratch 20 with the aid of the spring 22 which serves for turning the ratch 20 in the clockwise direction. As a result the sleeve roller 19 is firmly locked at the concave part 20*e* on the ratch 20 whereby the pocket P is displaced to the position where it is received in the interior of the framework 3**. Thus, pocket P is concealed from the outside without any possibility of opening the door casing by a security-defeating operation which may be performed by an unauthorized person who is desirous of stealing the bag or envelope including money to be deposited (see FIGS. 4 and 8(*d*)).

As the handle **6*a* on the front plate 6 is urged rearward further, the sleeve roller 19 is caused to move down and reaches the sliding guide member 35. At this moment the movable wall 15 is pivoted in the clockwise direction about the shaft 16 serving as a center of rotation owing to the arrangement of the sleeve roller 19 and the arm 17 in such a manner that the pocket disappears as the movable wall 15 is turned upward, as along as the sleeve roller 19 is located on the sliding surface of the guide member 35. When the outer curved surface of the movable wall 15 forms a continuation to that of the door casing 12, the guide ring 30 on the shaft 19*a* is brought into contact with the curved front surface 37' of the guide member 37. The above rotary movement of the movable wall 15 causes the bag or envelope held on the pocket to be thrown into the interior of the depository 2. When the door casing 12 is fully closed, the lower end part 48'' of the rotary stopper 48 comes in abutment against the lower stopper plate 49, while the curved surfaces of the door casing 12 and the movable wall 15 are located on the same circular track. As a result the bag or envelope including money to be deposited is received in the receptable 2 without any possibility of holding it on the movable wall 15** (see FIGS. 3 and 8(*d*)).

An advantageous feature of the present invention is that there is no possibility of an occurance of criminal activity owing to the arrangement that the sleeve roller 19 is firmly held by means of the engagement pawl of the ratch 20 which is depressed by the shaft 16 when an unauthorized person attempts to steal the bag or envelope in the pocket with the aid of a wire or like means while the door casing is kept in the half closed condition where the sleeve roller 19 is locked at the concave part 20 *e* of the engagement pawl of the ratch 20. Thus, excellent high security is ensured for the after hour depository of the present invention.

Specifically, there is no possibility of opening the door casing from the above-mentioned half opened condition because of the fact that the ratch 20 fails to swing rearward due to an engagement of the retaining rod **20*a* on the ratch 20 with the rectangular recess 34 of the holding plate 33 and a resultant limited movement of the ratch 20 when an unauthorized person attempts to perform criminal activity with the aid of a steel wire or the like which is inserted through a close clearance between the side wall of the framework and the side wall of the door casing for the purpose of allowing the ratch 20** to swing rearward. As long as the sleeve roller 19 is firmly held at the concave part 20*e* of the engagement pawl 20*c*, the door casing cannot be opened from the half opened position due to the arrangement that the shaft 16 is effective in depressing the back plate 25 of the ratch 20, even when he handles the wire or the like means so as to allow the ratch to be kept away from the engaged condition. Moreover, since the corrugated outer surface of the door casing 12 is brought into engagement with the corrugated inner surface of the guide member 13 while the door casing is half opened, it is entirely impossible to draw out a bag or an envelope held on the pocket through the very close clearance therebetween.

Next, FIGS. 9(*a*) and (*b*) illustrates a locking mechanism for the after hour depository in accordance with a modified embodiment of the present invention. This locking mechanism is constructed such that a key is required when either a bag or an envelope is used for the purpose of depositing money. Specifically, a key 41 is inserted from the front side of the framework 3 to rotate a connecting rod 51 which is intended to actuate a lever shaft 53, pivotally supported by means of bearings 52, said connecting rod 51 being connected tpo said lever shaft 53. A lever plate 54 is caused to swing by rotating the lever shaft 53 which is fixedly connected to the lever plate 54 by welding or the like. The plate 54 holds a locking rod 56 through a supporting rod 55. Locking is effected by means of a locking rod 56 adapted to be engaged to an engagement recess 57 on the side wall of the door casing 12, said locking rod 56, being reciprocably actuated by means of the lever plate 54 which is operatively engaged with the locking rod 56 by way of a pin 58. The lever plate 54 is formed with an elongated hole 59 through which the pin 58 is projected from the locking rod 56. Thus, rotational movement of the connecting rod 51 is smoothly converted into linear reciprocable movement of the locking rod 56 whereby locking or unlocking is ensured by engagement of the locking rod 56 to the engagement recess 57 or disengagement of the same therefrom.

Normally, the door casing 12 is fully closed and it can be opened only when unlocking is effected using a key 41 which is previously allotted to a customer. Thus, the after hour depository in accordance with the present invention ensures perfect locking and security from any security-defeating operation performed by an unauthorized person from the outside.

As described above, the after hour depository in accordance with the present invention is very simple in structured and is manufactured at an inexpensive cost. Further, it exhibits excellent security from any security-defeating operation owing to the arrangement that a combination of the sleeve roller on the door casing and the ratch on the side wall of the framework is effective in preventing the door casing from being intentionally opened by an anauthorized person while it is held in a half closed condition. The depository operates so that the door casing is pushed rearward after putting a bag or an envelope on the pocket. Another advantageous feature of the present invention is that the depository has excellent rigidity.

What is claimed is:

1. An after hour depository comprising a door casing rotatable between open and closed positions about a shaft extending across both the side walls of a framework, movable wall means in operative association with said door casing for developing a pocket in which a bag or an envelope including money to be deposited is placed, sleeve rollers disposed on both the sides of the movable wall means, ratch means for guiding the movement of said sleeve rollers under limitative control, wherein said ratch means includes a pivotal ratch having an engagement pawl with a concave portion against which the sleeve roller is adapted to be firmly held during return movement of said door casing from said open position to said closed position to prevent reverse pivotal movement of said door casing towards said open position, a back plate integral with said ratch, a driving plate located opposite to the ratch, said driving plate being pivotal in the opposite direction to that of said ratch, and holding plate means in operative association with said driving plate, said holding plate means being disengaged from said ratch in response to said driving plate being pivotally moved in a direction opposite said ratch by virtue of said sleeve rollers coming into contact therewith.

2. An after hour depository as defined in claim 1, further comprising means associating with said back plate for preventing pivotal movement of said ratch, said movement preventing means defining an opening having an upper surface which engages a shaft fixed to said ratch to prevent pivotal ratch movement of the ratch in an incorrect direction.

3. An after hour depository as defined in claim 1 further comprising locking means for permitting authorized access to said pocket, said locking means having a lock cylinder fitted into said framework, a key insertable into said lock cylinder and rotary locking plate rotatable in response to manipulation of said key so as to come into engagement with the side wall of the framework or to be disengaged therefrom.

4. An after hour depository as defined in claim 1 further comprising a locking mechanism comprising a lock cylinder fitted into the framework, a key insertable into said lock cylinder and a locking rod actuated by said key and movable in response thereto so as to come into engagement with an engagement recess defined on the side wall of the door casing or to be disengaged therefrom.

5. An after hour depository as defined in claim 1 further comprising a sliding guide member defining a surface against which the sleeve roller slides and wherein the sleeve roller is disposed on the side of the movable wall so that the movable wall is pivoted in such a direction as to reduce the pocket while the sleeve roller is located along the surface of said sliding guide member.

6. An after hour depository as defined in claim 1 wherein the door casing includes a concave partition against which the free end of the movable wall comes into contact during the pivotal movement thereof.

7. An after hour depository as defined in claim 1 wherein the movable wall is downwardly pivotal by way of is own dead weight in response to the sleeve roller leaving the upper end of the ratch during movement of the door casing to said open position.

8. An after hour depository as defined in claim 1 wherein the door casing and the movable wall each define a curved surface having the same radius of curvature and having a corrugated sectional configuration as seen in the transverse direction.

9. An after hour depository as defined in claim 8, further comprising guide means for guiding said door casing during pivotal movement thereof and wherein the door casing is pivoted while it is guided by said guide means disposed above the door casing, said guide means having a corrugated sectional configuration corresponding to that of the door casing.

10. An after hour depository as defined in claim 1 wherein the door casing includes a half cylinder portion at the lower part thereof which is pivotally supported by means of a guide plate.

11. An after hour depository as defined in claim 1 further comprising lamp means on the exterior of said framework to illuminate the exterior of said depository.

12. A security depository for valuables comprising:

a frame;

a door casing pivotally mounted to said frame for movement between closed and open positions and defining a pocket into which valuables are placed while said door is in said open position;

a movable wall member including mounting means for pivotally mounting said wall member to said door casing the permit pivotal movement of said wall member between a first position wherein access to said pocket is precluded and second position wherein access to said pocket is permitted in response to said door casing being pivotally moved between said closed and open positions, respectively; and means operatively associated with said movable wall member for preventing direction reversal of the pivotal movement of said door casing when said door casing is pivotally moved in a closing direction between said open position and said closed position, said direction reversal preventing means including (a) first and second opposing pivotal ratch members defining a space therebetween, said first ratch member defining a cam surface and said second ratch member defining a latch surface, (b) holding plate means pivotally attached to said first ratch member and movable between engaged and disengaged positions with said second ratch member in response to said first ratch member being pivoted between forward and rearward positions, respectively, said holding plate means for preventing pivotal movement of said second ratch member when said holding plate means is in said engaged position and for permitting pivotal movement of said second ratch member when said holding plate means is in said disengaged position, and (c) roller means rotatably mounted to said wall member and movable therewith into said space upon pivotal movement of said door casing in said closing direction, said roller means for initially contacting said cam surface during pivotal movement of said door casing in said closing direction to pivot said ratch member between said forward and rearward positions to responsively move said holding plate means to said disengaged position, said roller means for thereafter contacting said latch surface of said second ratch member to prevent movement reversal of said door casing in a direction opposite said closing direction.

13. A depository as in claim 12 wherein said second ratch member further includes means defining a second cam surface in said space and downstream of said first mentioned cam surface to pivotally move said second ratch member between advanced and retracted positions in response to said roller coming into contact therewith after said holding plate means has moved to said disengaged position by virtue of said roller means initially coming into contact with said first mentioned cam surface.

14. A depository as in claim 13 wherein said first ratch member includes first biasing means for biasing said first ratch member into said forward position and for biasing said linkage member into said engaged position.

15. A depository as in claim 14 wherein said second ratch member includes second biasing means for biasing said second ratch member into said advanced position.

16. A depository as in claim 12 wherein said first ratch member includes first biasing means for biasing said first ratch member into said forward position and for biasing said linkage member into said engaged position.

17. A depository as in claim 13 wherein said second ratch member includes second biasing means for biasing said second ratch member into said advanced position.

18. A depository as in claim 12 further comprising guide means fixed to said frame for guiding said roller means during pivotal movement of said door casing in a direction towards said open position.

19. A depository as in claim 12 further comprising locking means associated with said frame to permit authorized access to said pocket.

20. A depository as in claim 19 wherein said locking means includes a recess defined in said frame, a lock cylinder fixed to said frame, key insertable into said lock cylinder and turnable therein between locked and unlocked positions, and rotary locking plate means operatively associated with said lock cylinder and movable into and out of engagement with said recess in response to said key being turned between said locked and unlocked positions, respectively.

21. A depository as in claim 19 wherein said locking means includes a recess defined in said frame, a lock cylinder, a key insertable in said cylinder and turnable therein between locked and unlocked positions, rod means reciprocally movable into and out of said recess and means for translating the turning movement of said key to reciprocal movement of said rod means so that said rod means reciprocally moves into and out of said recess in response to said key being turned between said locked and unlocked position, respectively.

22. A depository as in claim 12 further comprising lamp means for illuminating the exterior thereof.

23. In combination with a building, a depository as in claim 12.

* * * * *